United States Patent [19]

Remington

[11] 4,395,892

[45] Aug. 2, 1983

[54] HARDWARE ASSEMBLY FOR LUGGAGE AND THE LIKE

[75] Inventor: Richard C. Remington, Pompton Plains, N.J.

[73] Assignee: Presto Lock, Inc., Garfield, N.J.

[21] Appl. No.: 224,036

[22] Filed: Jan. 12, 1981

[51] Int. Cl.[3] ..... E05B 37/02; E05B 65/52; A45C 13/10

[52] U.S. Cl. ..... 70/312; 70/69; 70/319; 292/38; 292/141; 292/171; 190/28

[58] Field of Search ..... 70/312, 298, 327, 69, 70/70, 71, 304, 67, 315, 316, 317, 319; 292/38, 141, 169, 171; 190/28; 150/1.6

[56] References Cited

U.S. PATENT DOCUMENTS

| | | | |
|---|---|---|---|
| 257,334 | 0/1882 | Huppe . | |
| 655,149 | 0/1900 | Goerk . | |
| 655,150 | 0/1900 | Goerk . | |
| 892,534 | 0/1908 | Masters . | |
| 981,843 | 0/1911 | Davis . | |
| 1,245,132 | 0/1917 | Tarshis et al. . | |
| 1,255,583 | 0/1918 | Christensen et al. . | |
| 1,287,652 | 0/1918 | Dembiczak . | |
| 1,454,651 | 0/1923 | Panyity . | |
| 1,615,120 | 1/1927 | Fischer | 292/171 |
| 2,153,916 | 4/1939 | Dunbar | 292/171 |
| 2,163,853 | 6/1939 | Pond | 70/312 |
| 2,238,266 | 0/1941 | Johnson | 70/116 |
| 2,242,550 | 0/1941 | Schell | 70/66 |
| 2,835,525 | 5/1958 | Vahtra | 292/169 |
| 3,135,105 | 6/1964 | Brody | 70/71 |
| 3,206,953 | 9/1965 | Atkinson | 70/70 |
| 3,306,402 | 2/1967 | Heitler et al. | 70/70 X |
| 3,405,544 | 10/1968 | Gehrie | 70/312 |
| 3,498,657 | 3/1970 | Fontana | 70/70 X |
| 3,555,860 | 1/1971 | Atkinson | 70/312 |
| 3,617,080 | 11/1971 | Miller | 292/38 |
| 3,633,388 | 1/1972 | Atkinson | 70/312 X |
| 3,910,611 | 0/1975 | Slovensky, Jr. | 292/38 |
| 4,100,775 | 7/1978 | Bako | 70/312 X |
| 4,123,923 | 11/1978 | Bako | 70/312 X |

FOREIGN PATENT DOCUMENTS

| | | | |
|---|---|---|---|
| 300369 | 4/1968 | Sweden | 70/70 |
| 2031055 | 4/1980 | United Kingdom | 70/312 |

*Primary Examiner*—Thomas J. Holko
*Assistant Examiner*—Lloyd A. Gall
*Attorney, Agent, or Firm*—Shapiro and Shapiro

[57] ABSTRACT

A hardware assembly, which is readily adaptable to luggage cases of widely varying constructions, dimensions and configurations, includes a housing which may be positioned within cut-outs in adjacent edges of the side walls of the luggage case, and be mounted on the exterior of one side wall. The housing contains slideable latches for engaging associated hasps mounted on the exterior of the other side wall, and a flexible member connecting the latches to a slideable actuator mounted on the housing for opening the case. The coupling between the latches and the flexible member allows the latches to move to unlatching position independently of the actuator to facilitate closing and latching of the case when the parts are brought together. The actuator is U-shaped and supported for transverse movement on the housing by a rocker located within the housing. A combination lock, which may have its combination changed by a push button projecting through the top of the housing, may be included for preventing movement of the actuator necessary to open the case.

48 Claims, 12 Drawing Figures

26
80
80
80
48
56
81
83
67
82
67
76
76
67
E'
67
82
67
70
E
66
70
66
76
76
250
P
84
128
A
144
246
222
144
76
82
36
38
110
100
103
D
130
126
116
124
142
140
185
246
112
106
104
114
34
140
142
250
F
90
96
L
94
92
132
128
152
164
220
150
160
151
148
130
126
100
110
116
152
221
225
230
38
112
103
235
224
36
104
234
160
228
174
C
146
226
32
D
106
166
120
57
121
124
34
F
151
236
102
114
150
96
154
184
90
94
188
176
174
H
B
118
136
60
51
92
L
78
78
55
108
50
54
248
78
78
169
248
77
74
78
57
62
248
22
120
41
108
168
60
47
136
78
55
47
77
H
44
40
51
46
42
72
50

HARDWARE ASSEMBLY FOR LUGGAGE AND THE LIKE

BACKGROUND OF THE INVENTION

This invention relates generally to hardware assemblies for luggage and the like such as consoles having spaced latches operated by one or more actuators which may be controlled by a combination lock.

Because of the large variety of luggage case constructions, manufacturers of luggage hardware have faced continual problems in providing hardware which can be used readily on a number of different types of cases. These problems are particularly acute with respect to hardware assemblies such as consoles in which spaced latches are operatively interconnected by a control mechanism to an actuator and/or to a combination lock. Such assemblies generally require that rather close tolerances be maintained between the various elements of the assembly in order to ensure proper operation. Since the actuator and combination lock are usually mounted on the exterior surface of a luggage case, whereas the control mechanism and latches are mounted on the interior of the case, such consoles generally must be specifically tailored to the particular type of case on which they are used, and are not readily adaptable to different types of luggage cases. Even the normal dimensional variations in side wall thickness between individual cases of a particular type can lead to mounting difficulties or contribute to poor or improper operation. Previous attempts to avoid such problems by providing the hardware assembly as part of a valance member which is attached to an edge of the case have been only partially successful in overcoming the problem of adaptability, since the problem is merely transferred to the valance designer.

In addition to considering side wall thickness, other factors which must be considered in designing a hardware assembly which is adaptable to different types of luggage cases include case configurations or shapes and valance constructions. For example, many hardware assemblies employ rigid control members for connecting the latches to an actuator and/or to a combination lock. If the hardware assembly is mounted on a case having a curved side wall, there may be a tendency for the control members to bind. Valance construction must be considered insofar as it affects case thickness, placement of the hardware assembly, and the dimensions of the hasps on the lid of the case which must cooperate with the latches to hold the case closed.

SUMMARY OF THE INVENTION

The invention provides improved hardware assemblies which overcome the above-mentioned and many other disadvantages of known hardware assemblies. The hardware assemblies of the invention are readily adaptable to luggage cases of widely varying constructions, dimensions, and configurations. For example, side wall thickness of the case may vary from as little as one-eighth inch, as for a molded plastic shell or a metal case, to as much as one-half inch or more, as for a wooden case. The hardware assemblies of the invention are easily adaptable to cases of different lengths, to cases having flat or curved side walls and to valanced or non-valanced cases. The hardware assemblies have a relatively simple construction, employ only a few parts, and are easily assembled.

Briefly, in accordance with one aspect a hardware assembly in accordance with the invention includes an elongated housing which is adapted to be mounted on the exterior of a side wall of a first part of the luggage case and to be positioned within an elongated cut-out in the edge of the first part, the housing having a portion which projects beyond the edge toward a second part of the case and which is adapted to be received in another elongated cut-out in an adjacent edge of the second part when the parts are brought together to close the case. Movable latch means is mounted within the housing and is cooperable with associated hasp means mounted on the exterior side wall of the second part of the case along the adjacent edge for holding the case closed when the parts are brought together. Actuator means is mounted on the housing for controlling the movement of the latch means.

In accordance with another aspect, a hardware assembly in accordance with the invention comprises a pair of sliding latches adapted to be mounted on a first part of a luggage case adjacent to an edge of the case for sliding movement parallel to the edge. The latches are cooperable with associated hasps on a second part of the case for holding the case closed when the parts are brought together. Also included are means for biasing the latches to latching position and a slideable actuator adpated to be mounted on the first part of the case, the actuator being slideable between a rest position and an open position in a plane parallel to a plane containing the latches and in a direction transverse to the direction of movement of the latches. Connecting means extend between the latches and the actuator for moving the latches to unlatching position when the actuator moves to open position. The connecting means is coupled to the latches in such a manner that the latches can move to unlatching position independently of the movement of the actuator to open position when the parts are brought together to close the case.

In accordance with yet another aspect of the invention, an end cap is provided for closing an open end of an elongated housing of a hardware assembly, the housing being adapted to be mounted on a first part of a luggage case and to be positioned within an elongated cut-out in the edge of the first part, a portion of the housing projecting beyond the edge toward a second part of the case and adapted to be received in another elongated cut-out in the edge of the second part when the parts are brought together, the housing including a latch cooperable with a hasp on the second part to hold the parts together when the case is closed. The end cap comprises a first portion shaped to fit within the open end of the housing and a curved portion projecting slightly beyond the open end which is shaped to cooperate with the elongated cut-out in the edge of the second part to cam the parts into alignment when they are brought together to close the case.

In accordance with still a further aspect, the invention provides a combination lock adapted for use in a hardware assembly. The lock comprises a frame, a longitudinally extending shaft supported on the frame, a plurality of sleeves rotatably supported on the shaft, each sleeve being coupled to an associated dial for rotation therewith, bolt means pivotally supported on the frame for rotation between locked and unlocked positions, the bolt means being cooperable with the sleeves and capable of moving to unlocked position only when the sleeves have a predetermined orientation, a rocker supported on the frame for rotation between first and second positions, and an actuator coupled to the rocker. The actuator is movable between a rest position and an open position and the rocker is movable with the actuator such that when the actuator is in the rest position the rocker is in the first position and when the actuator is in the open position, the rocker is in the second position. The bolt means and the roller have cooperable blocking means for preventing movement of the rocker from the first position except when the bolt means is in the unlocked position.

In accordance with another aspect, the invention provides a combination lock adapted for use in a hardware assembly. The combination lock comprises a frame, a longitudinally extending shaft supported on the frame, a plurality of sleeves rotatably supported on the shaft, each sleeve being releasably coupled to an associated dial for rotation therewith, a movable actuator, and combination changing means for moving the sleeves relative to the dials to uncouple the sleeves and the dials to enable the combination to be changed. The actuator includes means for preventing operation of the combination changing means except when the actuator is moved from a rest position to an open position.

In accordance with still another aspect, a hardware assembly in accordance with the invention comprises a latching assembly which is adapted to be mounted on a first part of a luggage case within an elongated cut-out in an edge of the first part with a portion of the latching assembly projecting beyond the edge toward a second part of the case. The projecting portion is adapted to be received in another elongated cut-out in an adjacent edge of the second part when the parts are brought together to close the case. A hasp assembly is adapted to be mounted on the second part of the case within the other cut-out, the latching assembly and the hasp assembly having cooperable means for holding the parts of the case together when the case is closed. First and second escutcheon means adapted to be mounted on the first and second parts of the case, respectively, are also provided for surrounding the latching assembly when the case is closed.

DESCRIPTION OF THE PREFERRED EMBODIMENT

The hardware assembly of the invention is primarily intended for use with luggage cases and similar articles and will be described in that environment, although, as will become apparent from the following description, it has a wider applicability.

Figure 1:
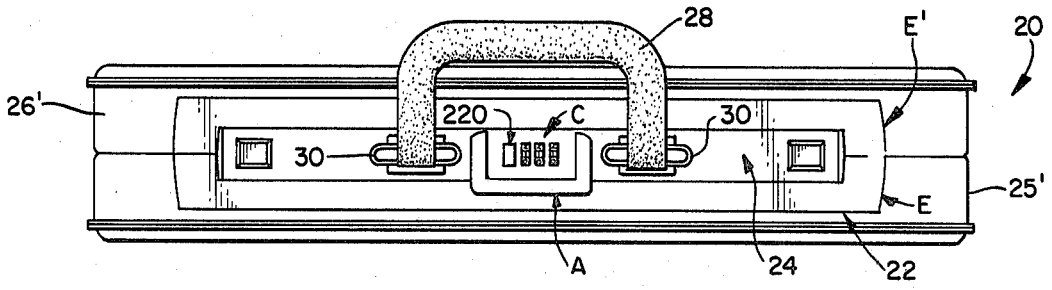
FIG. 1 is a top view of a luggage case employing a hardware assembly in accordance with the invention.

FIG. 1 is a top view of a luggage case 20, such as an attache case, employing a hardware assembly 22 in accordance with the invention centrally located thereon. As shown, and as will be described in detail hereinafter, the hardware assembly generally comprises a console housing 24 adapted to be mounted to a first part 25' of a luggage case, the housing including a pair of spaced latches for engaging associated hasps mounted on a second part 26' of the luggage case for holding the case closed (the latches and the hasps are not shown in FIG. 1). The latches are operated by a movable actuator A mounted on the housing, and a combination lock C may be included for controlling the movement of the actuator A. A handle 28 may also be mounted on the housing by handle studs 30 in a well-known manner. Although the hardware assembly of the invention is shown applied to a non-valanced luggage case having straight, i.e., flat, side walls, it will become apparent from the following description that the hardware assembly may also be used on valanced cases and cases having curved or contoured side walls. Furthermore, although shown applied to an attache case, it will become apparent that the hardware assembly may be easily adapted to larger cases.

Figure 2:
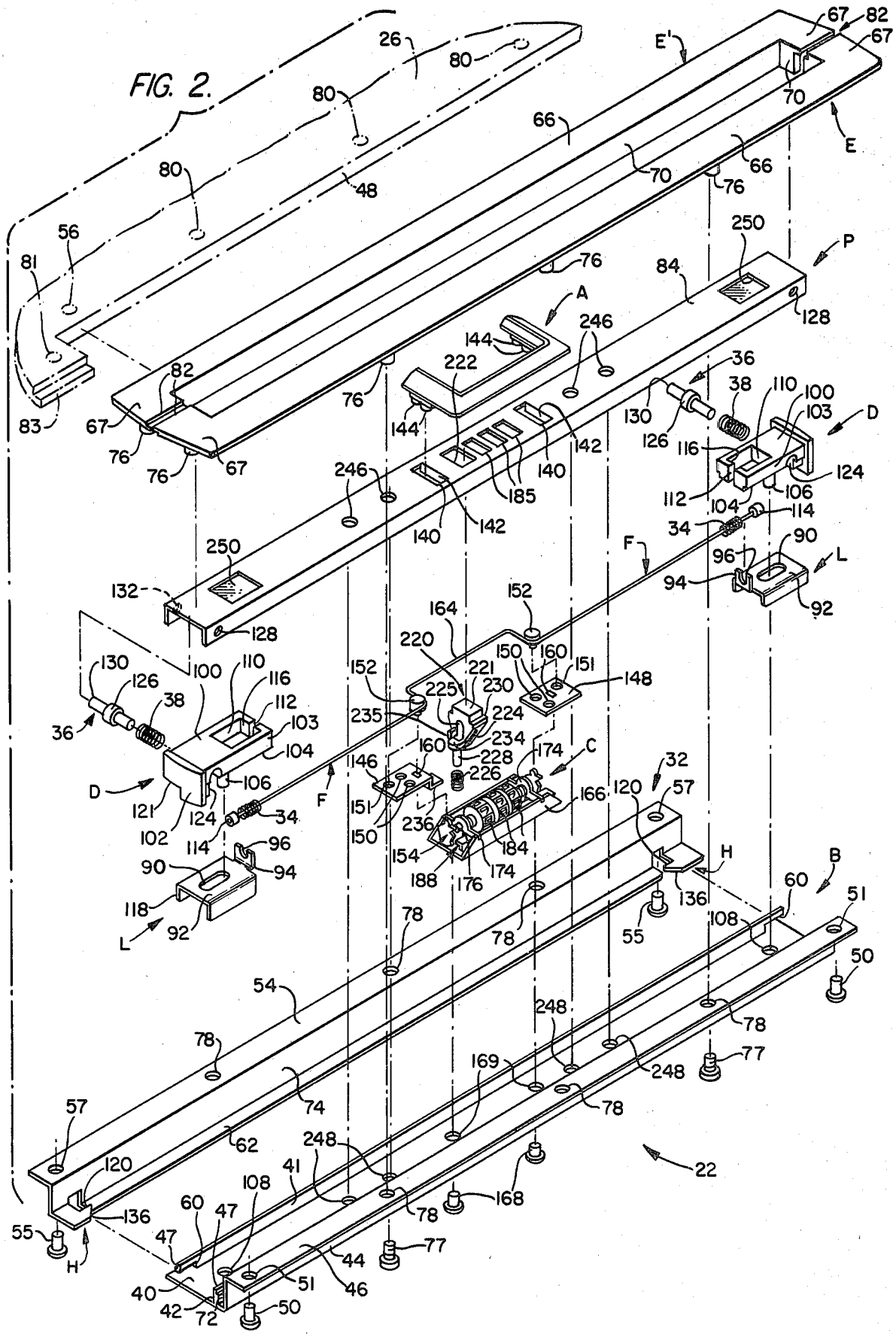
FIG. 2 is an exploded perspective view of a hardware assembly in accordance with the invention.

FIG. 2 illustrates the hardware assembly 22 of the invention in greater detail. As shown, and as will be described in greater detail hereinafter, the hardware assembly may include a generally U-shaped elongated channel or base B, and an inverted generally U-shaped elongated cover plate P adapted to be mounted on the channel to form an elongated tubular housing having a generally rectangular cross section. The ends of the housing may be closed by end caps D. A pair of sliding latches L may be located within the housing for engaging associated hasps H formed on an elongated hasp member 32 for holding the case closed. The latches may be connected to the actuator A by a flexible member or cable F, preferably formed of stranded stainless steel. Coil springs 34 coaxial with cable F may bias the latches outwardly to latching position, at which they engage the hasps. Actuator A may be slidably mounted on cover plate P for transverse movement (with respect to the direction of movement of the latches) between a rest position and an open position. When the actuator is moved to open position, the latches are moved inwardly to unlatching position, at which they disengage from the hasps. As previously mentioned, a combination lock C may be included for preventing movement of actuator A to open position except when the combination lock is on combination. However, as will be explained, the construction of the hardware assembly is such that the latches may be moved to unlatching position by the hasps independently of the movement of the actuator to open position when the parts of the case are brought together. This is convenient for enabling the case to be closed (and locked) when the combination lock is off combination. Ejector pins 36, biased by springs 38, may also be included within the housing for urging the parts of the case apart when the latches are moved to unlatching position, thus causing the case to "pop" open when the actuator is moved to open position. The hardware assembly may also include escutcheon plates E, E' for imparting a finished appearance to the assembly.

Figure 5:
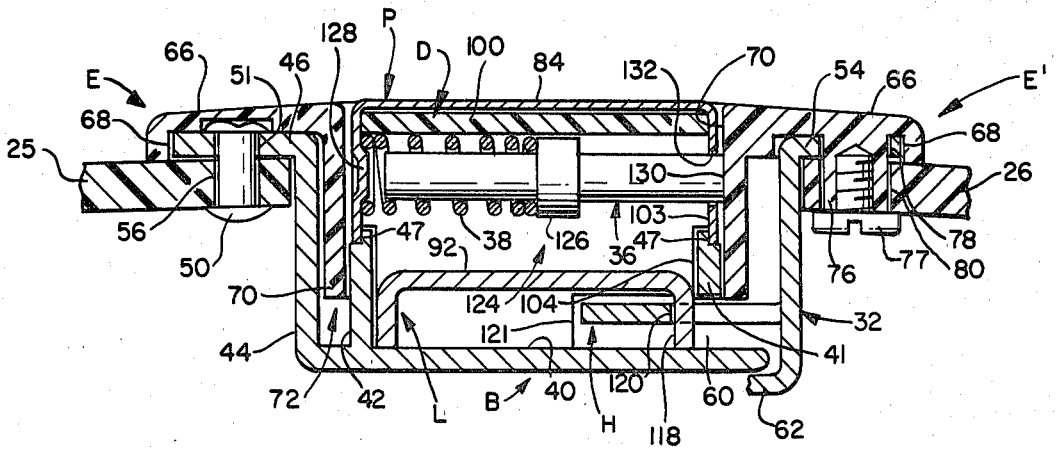
FIG. 5 is a transverse sectional view taken approximately along the line 5—5 of FIG. 3.
Figure 7:
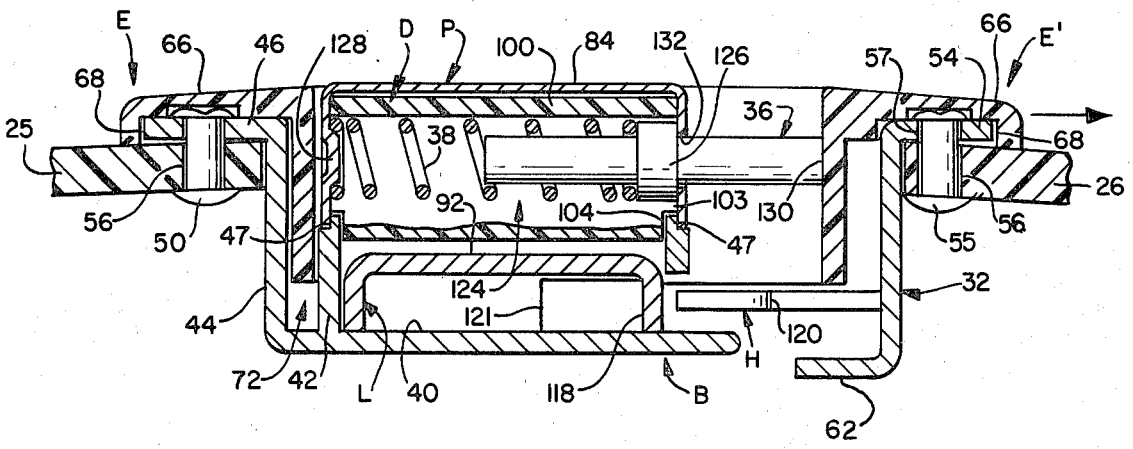
FIG. 7 is a transverse sectional view similar to FIG. 5 taken approximately along line 7—7 of FIG. 6 which illustrates the operation of an ejector device for moving the parts of the luggage case apart when the latch is moved to unlatching position.
Figure 10:
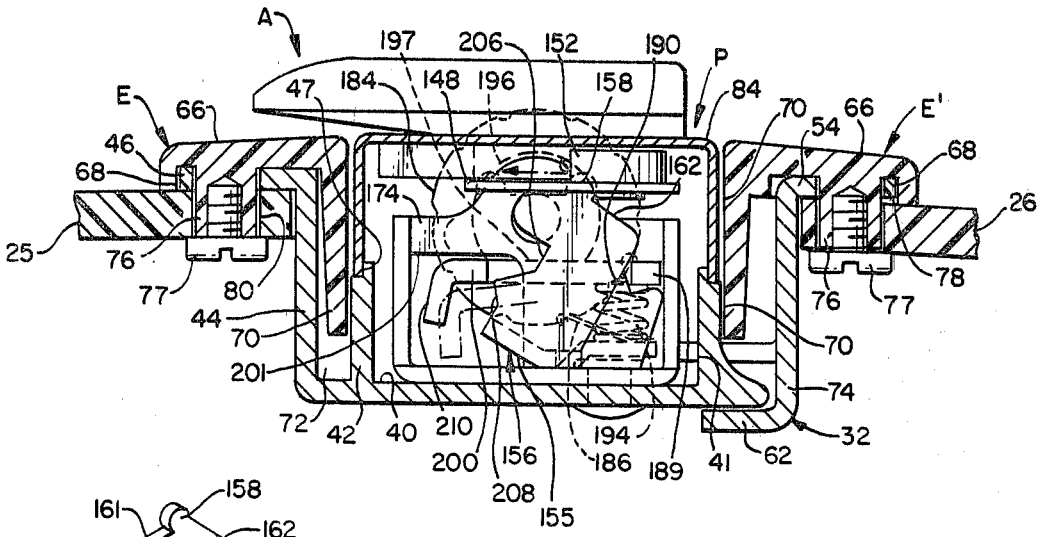
FIG. 10 is a transverse sectional view taken approximately along the line 10—10 of FIG. 9.

In greater detail now, channel B, which may be an extruded aluminum member, comprises a bottom portion 40 having longitudinal sides 41 and 42 extending upwardly therefrom, as illustrated in FIG. 2. Also extending outwardly and upwardly from bottom portion 40 adjacent to side 42 is an angled portion 44 which is coextensive with the length of the channel and which provides a flange 46 for mounting the channel on a luggage case. As best illustrated in FIGS. 5, 7, and 10, the longitudinal edges of the sides 41 and 42 are preferably stepped, as shown at 47, to provide a support for cover plate P. As previously mentioned, and as illustrated in the drawings, when the cover plate and the channel are assembled, they form an elongated tubular housing having a generally rectangular cross section, the open ends of which are closed by ends caps D. The cover plate is preferably formed of steel. Its main function is to cover the channel to form the housing and to support the actuator. In addition, being of steel, it also serves to strengthen and stiffen the hardware assembly. The housing encloses the various operating elements of the hardware assembly, such as the latches L, the combination lock C and the control mechanism, including cable F, which connects the latches to the actuator. Accordingly, the entire operating mechanism of the hardware assembly of the invention is enclosed within the housing, and the housing may be mounted as a unitary assembly on the luggage case.

Channel B may be mounted on the luggage case by positioning the channel within an elongated cut-out (not shown) in the edge of the case side wall 25 (similar to cut-out 48 in side wall 26 illustrated in phantom lines in FIG. 2 for hasp member 32) and by positioning flange 46 of angled portion 44 on the exterior surface of the side wall, as shown in FIGS. 5, 7 and 10. As shown, the channel may be fastened to the side wall by rivets 50 which extend through holes 56 in the side wall and holes 51 located in flange 46 adjacent to its opposite ends. Preferably, the depth of the cut-out in the edge of side wall 25 is approximately one-half of the width of the channel, so that half the width of the channel projects beyond the edge of the side wall (see FIG. 3). Cut-out 48 in side wall 26 is sized to receive the projecting half of the channel (as well as hasp member 32 and escutcheon plate E', as will be explained) so that the case may be closed.

Hasps H and hasp member 32 are preferably formed as a unitary assembly of stamped steel with a shape best illustrated in FIG. 2. As shown, the hasp member may be angled and may also have a flange 54 similar to flange 46 of the channel. The hasp member may be mounted within cut-out 48 of side wall 26 by positioning flange 54 on the exterior surface of the side wall, and by fastening the hasp member to the side wall with rivets 55 which pass through holes 56 in the side wall and holes 57 in the ends of flange 54. When the parts of the case are brought together, the portion of channel B which projects beyond the edge of side wall 25 is received within the recess formed by cut-out 48 in side wall 26, allowing the edges of the side walls to come together in abutting relationship to close the case. If desired, the side wall edges may be cooperatively notched for interfitting engagement as shown at 83 (see FIG. 2 which illustrates the notched edge of side wall 26). Notches or cut-outs 60 may be formed in side 41 of the channel to allow the hasps H to enter the housing and to be engaged by the latches. As shown in FIGS. 2, 4, 6, 9, and 10, the hasp member may have a projecting lip 62 adapted to be located beneath the bottom portion 40 of the channel to assist in positioning the hasps H properly within cut-outs 60 and to provide support to the portion of the channel adjacent to the hasp member when the case is closed.

Preferably, as mentioned, the hardware assembly also includes a pair of escutcheon plates E, E' which are preferably identical injection molded plastic members, shaped as best illustrated in FIG. 2. As shown, each escutcheon plate is preferably a shallow U-shaped member (as viewed from the top) having a longitudinal flange portion 66 and end flange portions 67. The escutcheon plates are adapted to be mounted on the side walls 25 and 26 of the luggage case and to cover flange portions 46 and 54 of channel B and hasp member 32, respectively, to impart a finished appearance to the hardware assembly, as best shown in FIG. 1. As shown, the escutcheon plates have a length sufficient to accommodate housing 24, i.e., channel B and cover plate P, and hasp member 32 between their end flange portions 67, and the end flange portions are preferably sized to extend to the edges of the side walls of the case. As shown in FIGS. 5, 7, and 10, the underside of the flange portion 66 of each escutcheon plate preferably has a recess 68 sized to accommodate flanges 46 and 54 of the channel and the hasp member, and the rivets which connect these parts to their respective side walls, to enable flange portions 66 to fit flush with the exterior surface of the side walls.

As also shown in the figures, the escutcheon plates have side walls 70 which depend from flange portions 66 and 67 at approximately a right angle. Side wall 70 of escutcheon plate E (which covers flange 46 of the channel) is positioned within a recess 72 formed between angle portion 44 and side 42 of the channel. Side wall 70 of escutcheon plate E' extends generally parallel to and covers the portion 74 of the hasp member which connects the hasps H and lip 62 with flange 54. Also formed on the undersides of the flange portions 66 and 67 of the escutcheon plates is a plurality of mounting studs 76 which may be threaded to receive threaded fasteners 77 for fastening the escutcheon plates to the case side walls. The mounting studs which depend from the underside of the longitudinal flange portions 66 of the escutcheon plates pass through aligned holes 78 in flanges 46 and 54 and through aligned holes 80 in the case side walls (see FIGS. 5, 7, and 10, for example) where they receive the threaded fasteners 77. Mounting studs 76 depending from the undersides of flanged portions 67 of the escutcheon plates are spaced beyond the ends of channel B and hasp member 32, as shown, for example, in FIGS. 3, 4, and 6. These mounting studs may similarly be received in holes 81 in the case side walls and may also receive threaded fasteners 77 for connecting these portions to the side walls.

Figure 3:
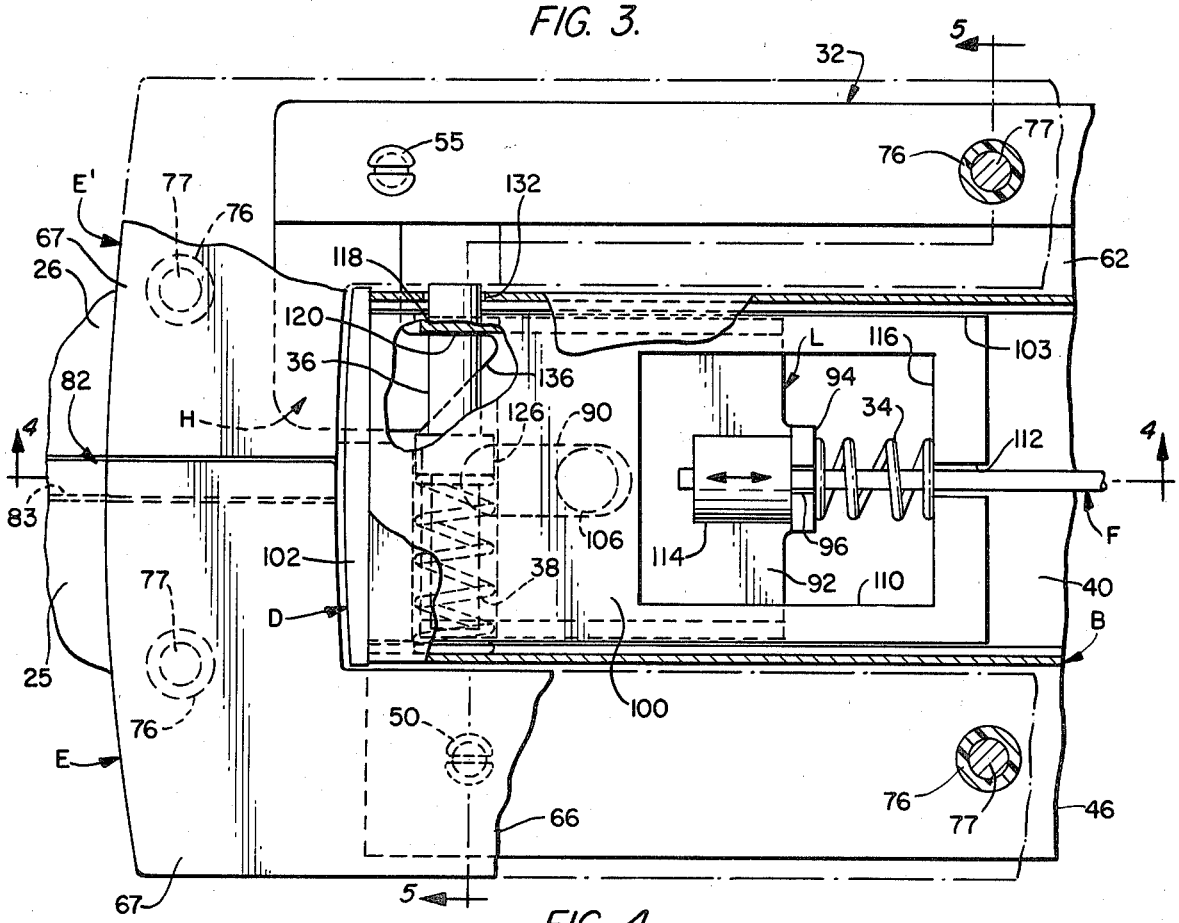
FIG. 3 is a top view partially broken away illustrating a portion of the hardware assembly of FIG. 2.

The abutting edges 82 of the end flange portions 67 of the escutcheon plates may be cooperatively notched for overlapping, interfitting engagement, as shown in FIGS. 2 and 3, so that there is no opening between the side walls of the case when it is closed. Preferably, the angled portion 44 of the channel and the escutcheon plates are sized so that when they are assembled, the top surfaces of the flange portions of the escutcheon plates are flush with the top surface 84 of the cover plate, as shown in FIGS. 4–7 and 10. It should be noted, that since the entire operating mechanism of the hardware assembly is associated with the housing, and the housing is mounted as a unitary assembly with respect to the exterior surface of case side wall 25, the relative positions between the top surfaces of the flange portions of the escutcheon plate and the cover plate, and the cooperation between the operating parts of the hardware assembly are unaffected by variations in side wall thickness. Accordingly, the hardware assembly may be readily adapted to luggage cases having widely varying side wall thicknesses. Moreover, the hardware assembly may be readily adapted to valanced cases by merely providing a recess in the underside of the end flange portions 67 of the escutcheon plates, similar to recess 68 for flanges 46 and 54, to enable the escutcheon to cover the valance and to mount flush on the exterior surface of the side walls. These are significant advantages of the invention over prior hardware assemblies.

The foregoing has presented a description of the overall construction of the hardware assembly of the invention and its mounting on a luggage case. The following will describe the various operating mechanisms, including the latching mechanism and the locking mechanism, employed in the hardware assembly.

As previously mentioned, and as shown in FIG. 2, the hardware assembly includes a pair of spaced latches L which engage the hasps H for holding the case closed (as will be described shortly) when the parts are brought together. The latches are preferably identical U-shaped slide members formed of stamped steel with a shape best illustrated in FIG. 2. As shown in FIGS. 2–7, the latches are disposed in an inverted-U position on the bottom 40 of the channel adjacent to cut-outs 60 in side 41 for the hasps and to the end caps D. The latches are sized with respect to the channel so that channel walls 41 and 42 confine the latches for sliding movement along the channel, i.e., longitudinally. As shown, each latch has a slot 90 in a central portion 92 of the latch and an up-turned projection 94 at one end of the central portion, the projection having a notch 96 therein through which cable F passes for coupling the latch to the cable (in a manner which also will be described shortly).

End caps D cooperate with the latches L and with other parts of the hardware assembly in several unique ways. As shown in FIGS. 2–7, the end caps, which are preferably formed from plastic, each have a generally rectangular first portion 100 sized to fit into an end of the housing, and another portion 102 which projects slightly beyond the end of the housing. As shown, the dimensions of projecting portion 102 are such that the portion abuts the ends of the channel and the cover plate when the end cap is inserted into the housing. The longitudinal sides 103 of portion 100 are inwardly notched at 104 so that when the end cap is inserted into the housing, portion 100 is supported on the tops of the stepped edges 47 of channel walls 41 and 42 adjacent to cover plate P. A mounting stud 106 depends from the underside of portion 100 to the bottom 40 of the channel B and may receive a threaded fastener 107 through a hole 108 in the bottom of the channel for fastening the end cap on the housing.

Figure 4:
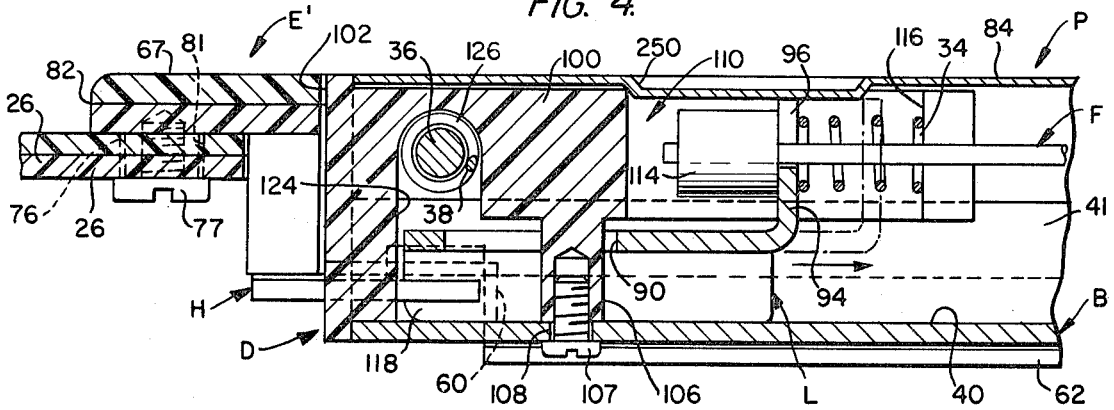
FIG. 4 is a longitudinal sectional view taken approximately along the line 4—4 of FIG. 3, this view illustrating a latch employed in the hardware assembly in latching position.
Figure 6:
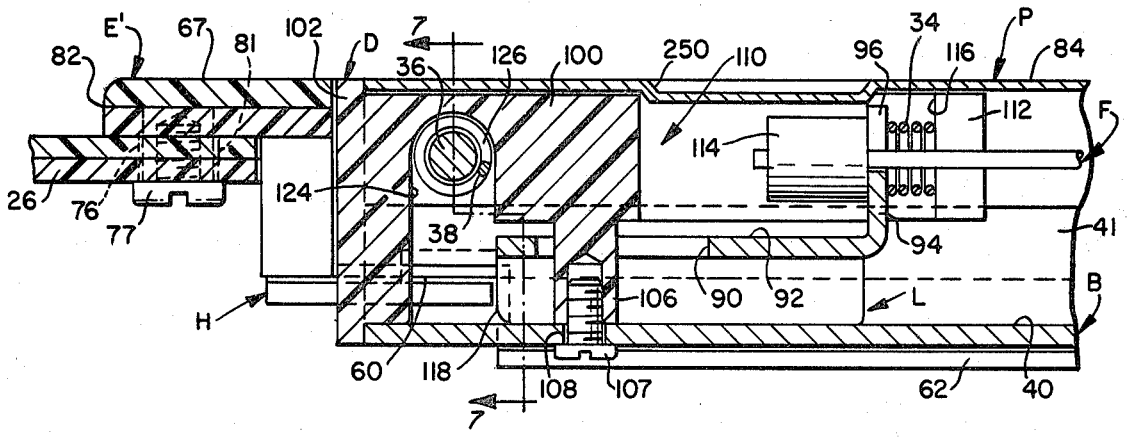
FIG. 6 is a longitudinal sectional view similar to FIG. 4 showing the latch in unlatching position.

As shown in FIGS. 3–7, each latch L is positioned beneath portion 100 of an end cap with mounting stud 106 extending through slot 90 in the latch, and with projection 94 of the latch received in a recess or cut-out 110 in portion 100. Slot 90 is sized to permit sufficient movement of the latch to engage and disengage from its associated hasp H. A slot or opening 112 extends between recess 110 and the end of portion 100 of the end cap which faces the center of the assembly, the slot being sized to pass cable F. The cable also passes through notch 96 in projection 94 of the latch as previously mentioned, and the end of the cable has a stop 114 thereon which abuts projection 94, as best illustrated in FIGS. 3, 4, and 6, for coupling the latch to the cable. As is also shown in these figures, recess 110 in portion 100 of the end cap is sized to also accommodate stop 114 and latch spring 34, and to permit sufficient movement of the latch to engage and disengage from the hasp H. Spring 34, which engages surface 116 of recess 110 and projection 94 of the latch biases the projection into engagement with stop 114, and urges the latch to latching position (to the left in FIGS. 3, 4, and 6). In latching position, the end of one leg 118 of the latch is positioned adjacent to cut-out 60 (as shown in FIGS. 3 and 4) where it engages a hook portion 120 of hasp H received in cut-out 60, in the manner shown in FIGS. 3–5. The end cap may have a cut-out 121 adjacent to cut-out 60 to enable the hasp to be received within the housing. When actuator A is operated, the ends of cable F are pulled together toward the center of the hardware assembly (in a manner which will be explained shortly) which, in turn, causes the latches to move together toward the center of the hardware assembly by virtue of the engagement between stops 114 and projections 94 of the latches. As shown in FIG. 6, when the latches move towards the center of the hardware assembly, the end of leg 118 of each latch disengages from its associated hasp H so that the case can be opened. This is the unlatching position of the latches. As is also shown in FIG. 6, when the latches move to unlatching position, coil springs 34 are compressed between projections 94 and surface 116 of recesses 110, so that when the actuator is released, the coil springs move the latches back to latching position. Accordingly, the latches are constantly urged to latching position by the coil springs.

As previously mentioned, to facilitate opening of the case when the latches are moved to unlatching position, the hardware assembly may also include ejector pins 36 biased by springs 38 for moving the parts of the case apart when the latches move to unlatching position. Preferably, an ejector pin 36 and coil spring 38 are positioned within a transverse recess 124 in each of the end caps D. As shown in FIGS. 2–7, each ejector pin may comprise a cylindrical shaft having an enlargement 126 centrally positioned thereon, to provide an abutment for coil spring 38. The coil spring is coaxial with the shaft on one side of the enlargement. To support the ejector pin within the housing, the opposite end of the coil spring from the end which engages enlargement 126 may be located on a boss 128 formed as an inward depression in the side of the cover plate adjacent to case side wall 25 and escutcheon plate E, and the other end 130 of the shaft may be located in a hole 132 in the other side of the cover plate which faces side wall 26 and escutcheon plate E′ (see FIGS. 2, 5 and 7). Coil spring 38 urges end 130 of the ejector pin out of the housing so that the ejector pin tends to assume the position shown in FIG. 7 whereby enlargement 126 abuts the side of the cover plate adjacent to hole 132. When the case is closed by bringing the parts together, the engagement between end 130 of the ejector pin and escutcheon plate E' on side wall 26 of the case forces the pin into the housing to the position shown in FIG. 5, compressing coil spring 38. The ejector is held in this position by virtue of the engagement between the latches and the hasp. Subsequently, when the actuator is operated to move the latches to unlatching position and they disengage from the hasps, coil spring 38 forces the ejector pin out of the housing, causing the parts of the case to be forced apart and moving the hasps out of cut-outs 60 to positions where they cannot be engaged by the latches (see FIG. 7). Thus, the action of the two ejector pins causes the case to pop open when the actuator is operated.

Closing of the case and engagement of the latches with the hasps to hold the case closed are facilitated by the previously described manner of coupling the cable F to the latches, since the latches may be moved relative to the cable and to stops 114 to unlatching position independently of the movement of the cable ends and independently of the operation of the actuator. This is accomplished in the following manner. As shown in FIGS. 2 and 3, each hasp H is formed with a sloping cam surface 136 adjacent to hook portion 120. When the parts of the case are brought together to close the case and the hasps enter cut-outs 60, cam surfaces 136 engage the ends of legs 118 of the latches, causing the latches to be moved relative to the cable (as shown in phantom lines in FIG. 4) to unlatching position. This compresses each coil spring 34 against surface 116 of its recess so that once the hasps have fully entered the housing, the coil springs force the latches back to latching position and into engagement with the hasps. Accordingly, the case may be closed and latched by simply moving the parts of the case together to closed position, without requiring manipulation or movement of the actuator. This is also a significant advantage of the invention, since, as mentioned previously and as will be described shortly, the hardware assembly preferably includes a combination lock for preventing movement of the actuator from rest position except when the combination lock is on combination. Thus, the case may be closed (and locked) when the combination lock is off combination. Also, portions 102 of the end caps cooperate with the walls 70 of escutcheon plate E' to assist in closing the case. As best shown in FIG. 3, portions 102 and end flange portions 67 of the escutcheon plate are curved slightly, portions 102 being tapered toward the sides of the cover plate. Thus, when the parts of the case are brought together, portions 102 and walls 70 of the escutcheon plate adjacent to end flange portions 67 cooperate to cam the parts together into proper alignment, thus facilitating closing of the case.

Figure 9:
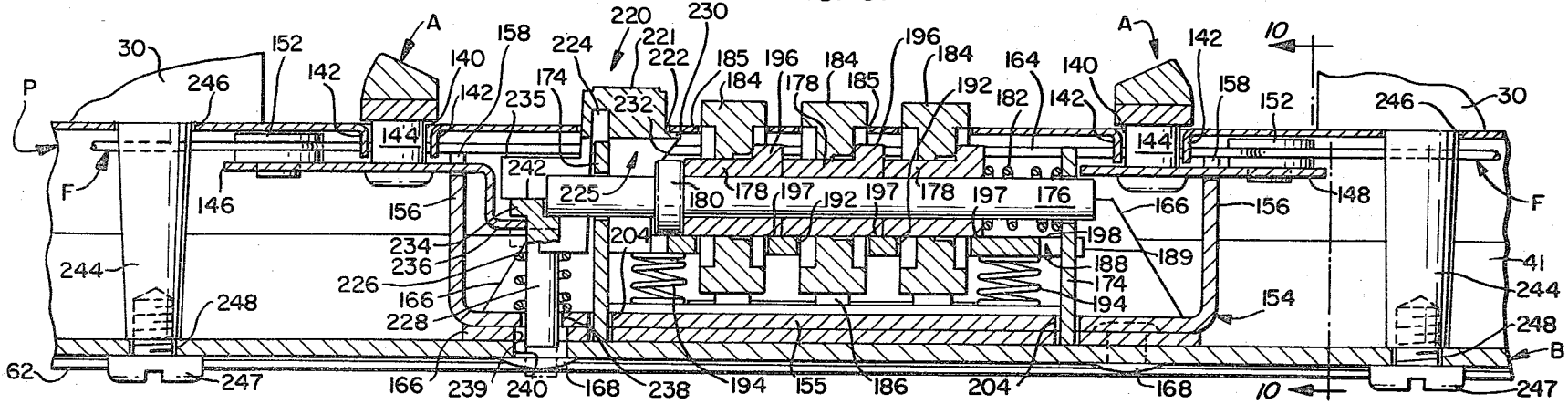
FIG. 9 is a longitudinal sectional view taken approximately along the line 9—9 of FIG. 8.

The spaced latches of the hardware assembly of the invention are operated simultaneously by the movement of the actuator A from a rest position to an open position. As shown in FIG. 2, actuator A, which is preferably a generally U-shaped die-cast member, may be mounted on the top surface 84 of cover plate P for sliding movement in transverse slots 140 formed in the cover plate. Cover plate P is preferably formed from stamped steel, and slots 140 are preferably formed by piercing the metal of the cover plate and bending it inwardly to form transverse tabs 142 (best illustrated in FIG. 9) on opposite sides of each slot. The tabs form a guide channel in each slot for a pair of bosses 144 formed on each leg of the actuator which project through the slots into the housing. Within the housing, the bosses connect each leg of the actuator to a bracket 146 and 148. The bosses extend through holes 150 in each bracket and have their ends swedged over (as shown in FIG. 9) to connect the brackets to the actuator. Mounted on each bracket by means of another hole 151 is a roller 152 over which cable F passes. The purpose of this arrangement will be described shortly.

Figure 11:
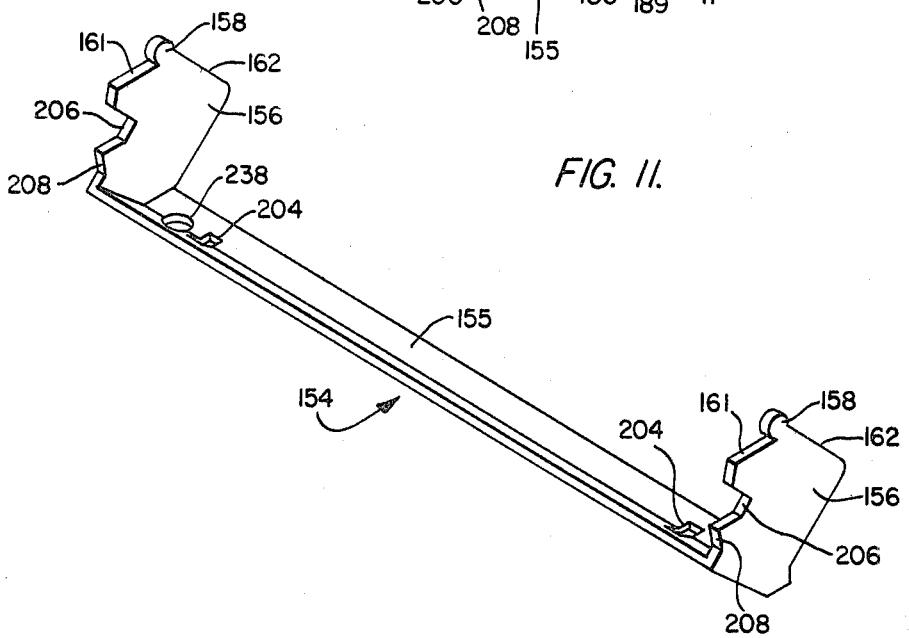
FIG. 11 is an enlarged perspective view of a rocker which may be employed in the combination lock of FIGS. 8–10.

Within the housing, brackets 146 and 148 are coupled to and supported on a rocker 154, which is best illustrated in FIG. 11. As shown, the rocker has an elongated angled base member 155 with a generally planar flange member 156 connected to each end thereof. The rocker, which is preferably part of the combination lock C as will be described hereinafter, is disposed longitudinally within the housing so that it may pivot or rock on base 155 about a longitudinal axis through the base. Each flange member 156 has an arcuate projection 158, which may be semi-circular as shown, which is adapted to be received in a slot 160 in each of brackets 146 and 148, and each flange member has a flat surface 161 adjacent to projection 158 which abuts the underside of the brackets when the rocker is in the position shown in FIGS. 10 and 11. In this position, which corresponds to the rest position of the actuator, the rocker supports the brackets and, in turn, the actuator. When the actuator is pulled to open position (down in FIG. 8 as indicated by the arrow and to the left in FIG. 10) the actuator and the brackets slide transversely with respect to the housing and the rocker pivots about base 155. Slots 160 in the brackets are sized with respect to projections 158 to allow the projections to pivot in the slots. When the actuator is in the open position, another surface 162 of each flange member abuts the underside of each bracket. The rocker supports the actuator during its movement and prevents the actuator from cocking or binding in its guide slots 140, which, because of the poor length to width relation of the U-shaped actuator, could otherwide occur. With the rocker, the actuator is able to move freely and smoothly between its rest position and its open position.

Figure 8:
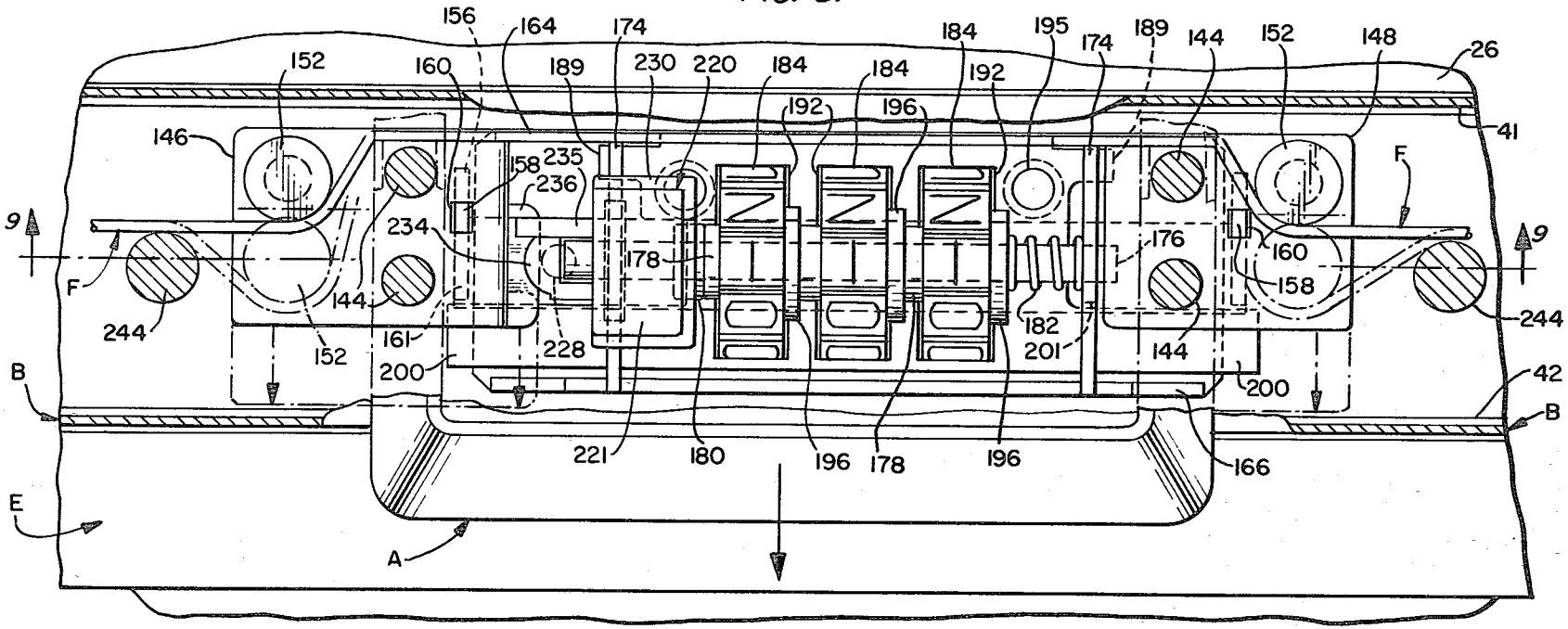
FIG. 8 is a plan view partially broken away of a portion of the hardware assembly of FIG. 2 illustrating a combination lock in accordance with the invention which may be employed in the hardware assembly.

The length of cable F which extends between latches L is adjusted so that the cable is taut when the latches are in latching position and the actuator is in rest position. The portion 164 of the cable between rollers 152 is held fixed against the side of the housing adjacent to side 41 of channel B to prevent transverse movement of portion 164 when the actuator is moved to open position. As shown in FIGS. 2 and 8, this may be accomplished by positioning portion 164 of the cable behind frame 166 of combination lock C, which is attached to the bottom of the channel by rivets 168 which extend through aligned holes 169 in the bottom of the channel and the frame. When the actuator is moved to open position, brackets 146 and 148 undergo a transverse movement, as previously described. Since portion 164 of the cable is held fixed, when the brackets undergo such movement, the cable slides past rollers 152 and is pulled to the phantom line position illustrated in FIG. 8. This causes the length of the cable between each latch and the actuator to be shortened, and the engagement of stops 114 with projections 94 of the latches causes the latches to move together. The amount of movement of the actuator to open position, which is determined by the length of slots 140, is selected to shorten the cable between each latch and the actuator sufficiently to move the latches to unlatching position, thereby releasing the hasps and opening the case. When the actuator is released, coil springs 34, which were compressed by projections 94 when the latches moved to unlatching position, force the latches back to latching position, which in turn moves the actuator back to rest position. Because the latches are located beneath portions 100 of end caps D and confined by channel sides 41 and 42, the latches are prevented from cocking or binding during their movements.

The use of a flexible member, such as a cable, as a control element connecting the latches and the actuator has certain advantages. For example, the hardware assembly of the invention may be readily adapted to luggage cases having curved, i.e., convex, side walls, since the cable is not subject to binding, as a rigid control member would be, when it passes over a curved surface. To adapt the hardware assembly to a luggage case having a curved side wall, it is merely necessary to conform the shapes of channel B, cover plate P, hasp member 32 and escutcheon plates E, E' to the shape of the side walls. Moreover, the length of the hardware assembly may be readily adjusted to accommodate different size luggage cases by merely adjusting the lengths of these elements and the length of cable F.

As previously mentioned, the hardware assembly of the invention may include a combination lock C for locking the case. Preferably, the combination lock prevents movements of the actuator from the rest position except when the combination lock is on combination, thereby preventing operation of the actuator necessary to move the latches to unlatching position. To accomplish this, the combination lock may be used to block the movement of rocker 154, as will be described. Preferably, combination lock C is a pivoted bolt combination lock, which, except as will be described hereinafter, may be generally similar to well-known combination locks of this type.

As shown in FIGS. 8–10, combination lock C may include a frame 166 having brackets 174 thereon for supporting a longitudinally extending shaft 176 which rotatably supports a plurality of sleeves 178. The sleeves are held in end-to-end abutting relationship against an enlargement 180 near one end of the shaft by a spring 182 on the opposite end of the shaft which engages an adjacent sleeve and bracket 174. Each sleeve may be releasably coupled to an associated combination dial 184 for rotation therewith, and the dials may project through slots 185 in cover plate P, which serves as a faceplate, to display successive indicia spaced about the periphery of the dials. A dial spring 186 may be included for holding each dial in successive rotational positions.

Figure 12:
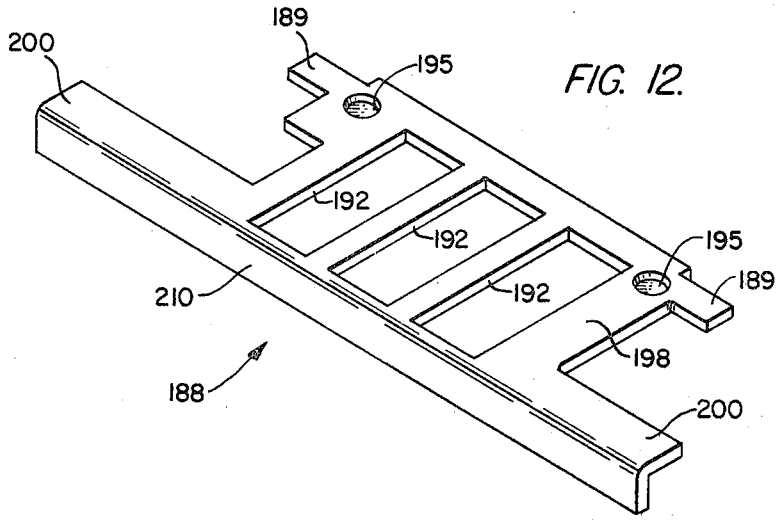
FIG. 12 is an enlarged perspective view of a bolt which may be employed in the combination lock of FIGS. 8–10.

A bolt 188, shown in greater detail in FIG. 12, may be pivotally supported on the frame for rotation about an axis parallel to the axis of shaft 176 by locating tabs 189 of the bolt in corresponding cut-outs 190 (see FIG. 10) in brackets 174. The bolt may have a plurality of transverse slots 192 through which the dials pass and may be biased into engagement with the sleeves by bolt springs 194 located between the frame and bosses 195 in the bolt adjacent to tabs 189. As is well known, the sleeves may have a circular flange portion 196 and a flat portion 197 which engage the planar surface 198 of the bolt adjacent to slots 192. When the dials are rotated to position the flat portions 197 of all of the sleeves adjacent to the surface 198 of the bolt, bolt springs 194 pivot the bolt about tabs 189 to a horizontal position, as illustrated in FIGS. 9 and 10. This is the unlocked position of the combination lock. When any dial is turned off combination, the circular flange portion of its associated sleeve engages the surface of the bolt, causing the bolt to pivot downwardly to locked position (shown in phantom lines in FIG. 10).

As is also shown in FIG. 12, the side of the bolt opposite to tabs 189 may have extensions 200 which project beyond brackets 174 through cut-outs 201 in the brackets (see FIG. 10). The extensions 200, which constitute blocking elements, cooperate with flange members 156 of the rocker to prevent movement of the rocker from the position corresponding to the rest position of the actuator except when the combination lock is on combination. Rocker 154 is preferably formed as part of the combination lock with base 155 of the rocker supported on the bottom of frame 166. As shown in FIGS. 2 and 8–10, rocker flange members 156 are positioned beyond brackets 174 of the combination lock. The brackets 174 may have cut-outs for base 155 (not shown) and may have projecting tabs (also not shown) which are received in notches 204 in base 155 of the rocker, for locating the rocker on the frame. When assembled with the combination lock, flanges 156 of the rocker are positioned adjacent to the ends of extensions 200 of the bolt (see FIGS. 2, 8, and 10). As best illustrated in FIG. 11, the edge of each flange member 156 adjacent to extensions 200 may be formed with a cut-out 206 into which an extension 200 of the bolt is received when the bolt is in unlocked position, i.e., in the horizontal position illustrated in solid lines in FIG. 10, and the actuator is moved to open position. When the bolt is moved to locked position (phantom line position illustrated in FIG. 10) a blocking surface 208 of flange members 156 is positioned adjacent to an extension of the bolt, which blocks movement of the rocker necessary for the actuator to move to open position. Accordingly, when the combination lock is off combination, the actuator is prevented from moving to open position, necessary to move the latches to unlatching position. As shown in FIG. 12, side 210 of the bolt adjacent to extensions 200 may be angled to impart greater strength to the extensions and to increase their resistance to bending due to the forces exerted on them by the rocker.

The combination lock C also incorporates a novel combination changing mechanism which permits the combination of the lock to be changed from the faceplate of the lock, i.e., from the same side of the lock on which the combination dials are accessible. The combination changing mechanism comprises a shifter 220 (FIGS. 2, 8 and 9) which includes a push button portion 221 projecting through a slot 222 in cover plate P adjacent to dial slots 185. The shifter is located on the left-hand (in the figures) bracket 174 of the combination lock frame by means of a transverse vertical slot 224 and on the shaft 176 adjacent to enlargement 180 by means of a longitudinal vertical slot 225 which receives the shaft (see FIG. 9). A coil spring 226 located on a depending projection 228 of the shifter biases the push button portion of the shifter away from the cover plate (upwardly in FIG. 9) so that a lip 230 at the base of the push button portion engages the underside of the cover plate. As shown in FIG. 9, the portion of the shifter adjacent to enlargement 180 on the shaft is formed with an angled cam surface 232, and the opposite side of the shifter adjacent to the end of the shaft is formed with a ledge 234 and a vertical tab 235 on one side of the upper surface thereof. As is also shown in FIG. 9, bracket 146 (attached to the left-hand leg of the actuator) has a generally L-shaped tab portion 236 which is positioned beneath ledge 234 of the shifter. Depending projection 228 of the shifter extends through an opening 238 in the rocker (see FIG. 11 also) and into aligned holes 239 and 240 in frame 166 and channel B, respectively.

In order to change the combination, the lock must be first set on combination and the actuator A moved to and held in open position, in order to enable shifter 220 to be depressed. As shown in FIGS. 8 and 9, when the actuator is in rest position, tab 236 of bracket 146 is located beneath ledge 234 of the shifter, which prevents the shifter from being depressed. When the actuator is moved to open position (downwardly in FIG. 8 in the direction of the arrow) tab 236 is moved out from beneath ledge 234 to the phantom line position illlustrated, where it is out of blocking alignment with the shifter. The shifter may then be depressed against the bias of spring 226 to move it to its combination changing position. As the shifter is depressed, cam surface 232 engages enlargement 180 on the shaft to move the shaft and the sleeves 178 to the right in FIGS. 8 and 9 against the bias of spring 182. As is well known, each sleeve may have teeth received in recesses in its associated dial (the teeth and the recesses are not shown in the drawings) for keying the dials and the sleeves together. Movement of the sleeves to the right in the figures by depressing shifter 220, disengages the teeth of the sleeves from the dials so that the dials may be rotated independently of the sleeves to the new combination.

To facilitate changing of the combination, tab 236 and ledge 234 on the shifter cooperate to hold the shifter in the combination changing position. Upon moving the actuator to open position and depressing the shifter, if the shifter is held depressed and the actuator is released, latch springs 34 will move the actuator back toward rest position, as previously described, causing tab 236 to be positioned adjacent to the upper surface 242 of ledge 234. Engagement between tab 236 and the upper surface 242 of ledge 234 prevents spring 226 from returning the shifter to its combination fixing position (illustrated in FIG. 9) and holds the shifter in the combination changing position, thereby freeing the user's hands and facilitating changing of the combination. Engagement between vertical tab 235 on the shifter and tab 236 on the bracket prevents the actuator from moving completely to its rest position when it is released, and contributes to slightly smoother operation of the mechanism. When the new combination has been set, moving the actuator to open position releases the shifter and enables spring 226 to return the shifter to the combination fixing position. At the same time, spring 182 returns the shaft and the sleeves to their normal positions illustrated in FIGS. 8 and 9 where the sleeves recouple to the dial, thereby setting the new combination into the lock. As the shaft moves back to its normal position, the engagement between enlargement 180 on the shaft and cam surface 232 of the shifter also forces the shifter upwardly (in FIG. 9) and assists spring 226 in returning the shifter to the combination fixing position.

Preferably, combination lock C and actuator A are located centrally in the cover plate of the housing between handle studs 30, as shown in FIG. 1. To connect handle 28 to the hardware assembly, handle studs 30 may have mounting posts 244 (see FIG. 9) which extend through holes 246 in the cover plate and receive threaded fasteners 247 through aligned holes 248 in the channel. Accordingly, when the luggage case is being carried, the entire weight of the case is on the channel rather than on the cover plate. Mounting posts 244 also may cooperate with rollers 152, in the manner indicated in FIGS. 8 and 9, to shorten cable F when the actuator moves to open position. Cover plate P may also be formed with depressions 250 (FIG. 2) which are adjacent to and are sized to fit within recesses 110 of end caps D, as shown in FIGS. 4 and 6, and which assist in positioning the end caps within the housing.

From the foregoing, it may be appreciated that the hardware assembly of the invention has significant advantages over comparable prior hardware assemblies. For example, as previously described, the invention provides a hardware assembly as an integral unit which may be readily adapted for use on luggage cases of different sizes, shapes, and configurations. Moreover, the hardware assembly of the invention has a relatively simple construction and employs a relatively small number of parts which may be quickly and readily assembled.

While a preferred embodiment of the invention has been shown and described, it will be apparent to those skilled in the art that changes can be made in this embodiment without departing from the principles and spirit of the invention, the scope of which is defined in the appended claims.

The invention claimed is:

1. A hardware assembly for luggage and the like comprising an elongated housing adapted to be mounted on the exterior of a side wall of a first part of the luggage case and to be positioned within a elongated cut-out in the edge of the first part, the housing having a portion projecting beyond said edge toward a second part of the case which is adapted to be received in another elongated cut-out in an adjacent edge of the second part when the parts are brought together to close the case, a pair of sliding latches mounted within the housing, the latches being movable longitudinally within the housing between latching and unlatching positions and being engageable, when in latching position, with associated hasp means mounted on the exterior of the side wall of the second part of the case along said adjacent edge for holding the case closed when the parts are brought together, an actuator mounted on the housing for transverse movement with respect to the direction of movement of the latches for controlling the movement of the latches, means for connecting the latches to the actuator, a rocker pivotally supported within the housing, and means for coupling the rocker to the actuator for movement therewith.

2. The assembly of claim 1, wherein the connecting means comprises means for enabling movement of the latches to unlatching position independently of the movement of the actuator to an open position when the parts of the case are brought together.

3. The assembly of claim 2, wherein the connecting means comprises a flexible member extending between the latches and slideably coupled to the actuator.

4. The assembly of claim 1, further comprising a combination lock within the housing, the combination lock having means for preventing movement of the actuator to an open position except when the combination lock is on combination.

5. The assembly of claim 4, wherein the preventing means comprises means engageable with the rocker for impeding movement of the rocker.

6. The assembly of claim 1, further comprising escutcheon means adapted to be mounted on the exterior of the side wall of the first part of the case, the escutcheon means being formed to extend parallel to the housing and to a portion of each end of the housing, and to cover a portion of the housing mounted on the exterior side wall.

7. The assembly of claim 6, further comprising another escutcheon means adapted to be mounted on the exterior of the side wall of the second part of the case along said adjacent edge, said other escutcheon means being shaped to extend parallel to the housing and to cover another portion of the housing.

8. The assembly of claim 7, wherein said other escutcheon means and the ends of the housing are cooperatively shaped to cam the first and second parts of the case into proper alignment when the parts are brought together.

9. The assembly of claim 1, wherein the housing comprises an elongated channel member having a flange portion along a longitudinal side thereof, the channel member being attached to the exterior of the side wall of the first part of the case by said flange portion, and a cover member mounted on the channel member to form a generally tubular structure having open ends.

10. The assembly of claim 9, further comprising end caps closing the ends of said tubular structure, each end cap having a curved portion which projects slightly beyond a corresponding end of the tubular structure and which cooperates with means associated with said other cut-out to cam the parts of the case into alignment when the parts are brought together.

11. The assembly of claim 1, further comprising spring biased ejector means within the housing for urging the parts of the case apart when the actuator is moved to an open position.

12. The assembly of claim 1, further comprising a carrying handle mounted on the housing.

13. A hardware assembly for luggage and the like comprising a pair of sliding latches adapted to be mounted on a first part of a luggage case adjacent to an edge thereof for sliding movement parallel to said edge, the latches being movable between latching and unlatching positions and being cooperable with associated hasps on a second part of the case for holding the case closed when the parts are brought together, means for biasing the latches to latching position, a slideable actuator adapted to be mounted on the first part of the case, the actuator being slideable between a rest position and an open position in a plane parallel to a plane containing the latches and in a direction transverse to the direction of movement of the latches, connecting means extending between the latches and the actuator for moving the latches to unlatching position when the actuator moves to open position, and means for coupling the connecting means to the latches to enable the latches to move with respect to the connecting means such that the latches can move to unlatching position independently of the movement of the actuator to open position when the parts are brought together to close the case.

14. The assembly of claim 13, wherein the connecting means comprises a flexible member extending between the latches and slideably coupled to the actuator.

15. Assembly of the claim 14, wherein the actuator comprises a generally U-shaped member having a pair of legs and having roller means adjacent to the end of each leg, the flexible member passing over the roller means and being held in a fixed position between the roller means such that movement of the actuator to open position is effective to shorten the length of the flexible member between the latches to move the latches together to unlatching position.

16. The assembly of claim 15, wherein the U-shaped member has a bracket attached to each leg adjacent to the end of the leg, and the roller means comprises a roller mounted on each bracket.

17. The assembly of claim 14, wherein the flexible member comprises a cable and the coupling means comprises stop means on each end of the cable and a projection on each latch with an opening therethrough for the cable, and wherein the biasing means comprises spring means for biasing each projection into engagement with an associated stop means.

18. The assembly of claim 17, wherein the spring means comprises coil springs coaxial with the cable which urge the latches apart to latching position.

19. The assembly of claim 18, wherein the hasps and the latches have cooperable cam means for moving the latches to unlatching position against the bias of the coil springs when the parts of the case are brought together, and have engageable surfaces for holding the parts together when the case is closed.

20. The assembly of claim 13, further comprising an elongated housing, the latches being disposed within the housing and the actuator being mounted thereon, and the housing adapted to be mounted on the exterior of a side wall of the first part of the luggage case and to be positioned within an elongated cut-out in the edge of the first part.

21. The assembly of claim 20, wherein the housing comprises an elongated channel having a flange portion for mounting the channel on the exterior of said side wall, a cover mounted on the channel to form a generally tubular structure having open ends, and end caps closing the ends of such structure.

22. The assembly of claim 21, wherein each end cap includes a portion shaped to fit within an end of the tubular structure and to be positioned between the cover and one of the latches, the portion having a recess therein for receiving a projection from such latch and an opening connecting the recess with an interior end of the portion for passing the connecting means, the connecting means being coupled to the projection within the recess and the biasing means being located within the recess between the projection and a surface of the recess adjacent to said opening.

23. The assembly of claim 22, wherein the end cap has another recess located between said first-mentioned recess and another end of the end cap, and wherein the assembly further comprises spring biased ejector means located within the later-mentioned recess for urging the parts of the case apart when the latches are moved to unlatching position.

24. The assembly of claim 13, wherein the hasps are part of an elongated flanged member adapted to be mounted on the exterior of a side wall of the second part of the case.

25. The assembly of claim 13, further comprising a rocker supported on the first part of the case for pivotal movement between first and second positions about an axis parallel to the direction of movement of the latches, the rocker having means for supporting the actuator and for constraining the rocker and the actuator for concerted movement, the rocker being in the first position when the actuator is in the rest position and being in the second position when the actuator is in the open position.

26. The assembly of claim 25, further comprising a combination lock for controlling the movement of the rocker.

27. The assembly of claim 26, wherein the combination lock and the rocker have cooperable blocking means for preventing movement of the rocker from the first position except when the combination lock is on combination.

28. The assembly of claim 13, further comprising a combination lock for preventing movement of the actuator to the open position except when the combination lock is on combination.

29. The assembly of claim 28, wherein the combination lock comprises a frame, a shaft supported on the frame, a plurality of sleeves rotatably supported on the shaft, each sleeve being releasably coupled to an associated dial for rotation therewith, and combination changing means for moving the sleeves relative to the dials to uncouple the sleeves and the dials to enable the combination to be changed, the actuator having means for preventing the operation of the combination changing means except when the actuator is in the open position.

30. A hardware assembly for luggage and the like comprising a housing with an open end, the housing adapted to be mounted on a first part of a luggage case and to project beyond an edge of the first part toward a second part of the case and to be received in a cut-out in an edge of the second part when the parts are brought together to close the case, and an end cap for closing the open end of the housing, the end cap comprising a member having a first portion shaped to fit within the open end of the housing, and a curved portion projecting slightly beyond said open end, the curved portion being shaped to cooperate with means associated with said cut-out to cam the parts into alignment when the parts are brought together to close the case.

31. The assembly of claim 30, wherein the housing encloses a latch cooperable with a hasp on the second part of the case to hold the parts together when the case is closed, and wherein said first portion has a recess therein for receiving a projection from the latch and an opening therethrough connecting the recess with an end of the first portion, said recess being sized to receive biasing means for biasing the latch to latching position, and the opening being sized to pass control means for connecting the latch to an actuator.

32. The assembly of claim 31, wherein the first portion has another recess for receiving spring biased ejector means for urging the parts of the case apart when the latch is moved to unlatching position.

33. A combination lock adapted for use in a hardware assembly for luggage and the like comprising a frame, a longitudinally extending shaft supported on the frame, a plurality of sleeves rotatably supported on the shaft, each sleeve being coupled to an associated dial for rotation therewith, bolt means pivotally supported on the frame for movement between locked and unlocked positions, the bolt means being cooperable with the sleeves and capable of moving to unlocked position only when the sleeves have a predetermined orientation, a rocker supported on the frame for movement between first and second positions, and an actuator coupled to the rocker, the actuator being movable between a rest position and an open position, the rocker being movable with the actuator and being in the first position when the actuator is in the rest position and being in the second position when the actuator is in the open position, the bolt means being pivotally supported about an axis parallel to the axis of the shaft and the rocker being pivotally supported about another axis parallel to the axis of the shaft, and the bolt means and the rocker having cooperable blocking means for preventing movement of the rocker from the first position except when the bolt means is in the unlocked position.

34. The combination lock of claim 33, wherein the actuator is mounted for sliding movement in a transverse direction to the longitudinal axis of the shaft.

35. The combination lock of claim 33, wherein the rocker comprises a base for supporting the rocker on the frame and a pair of members extending from opposite ends of the base, each member having a projection which is received in a slot in bracket means attached to the actuator and having a portion adjacent to the projection for supporting the bracket means, the slots in the bracket means being sized with respect to the projections to enable the projections to rotate in said slots when the rocker moves between its first and second positions and the actuator moves between its rest and open positions.

36. The combination lock of claim 35, wherein the cooperable blocking means comprises extended portions of the bolt means which abut sides of corresponding members when the bolt means is in locked position.

37. The combination lock of claim 36, wherein the members have cut-outs in their sides which receive an extended portion of the bolt means when the bolt means is in unlocked position and the rocker is in the second position.

38. The combination lock of claim 33, further comprising combination changing means accessible from a faceplate of the combination lock through which the dials project for uncoupling the sleeves from the dials to enable the combination to be changed, the actuator having means engageable with the combination changing means for preventing operation of the combination changing means except when the actuator is in open position.

39. A combination lock adapted for use in a hardware assembly for luggage and the like comprising a frame, a longitudinally extending shaft supported on the frame, a plurality of sleeves rotatably supported on the shaft, each sleeve being releasably coupled to an associated dial for rotation therewith, an actuator movable between a rest position and an open position, the actuator being movable from the rest position only when the sleeves have a predetermined orientation, and combination changing means for moving the sleeves relative to the dials to uncouple the sleeves and the dials to enable the combination to be changed, the actuator having means for preventing operation of the combination changing means except when the actuator is in the open position.

40. The combination lock of claim 39, wherein the combination changing means comprises a member movable between a combination fixing position and a combination changing position, and wherein the preventing means comprises means attached to the actuator for engaging the movable member when the actuator is in the rest position to prevent movement of the movable member to the combination changing position.

41. The combination lock of claim 40, wherein the movable member has a portion cooperable with the engaging means for holding the movable member in the combination changing position upon the actuator being moved toward rest position while the movable member is in the combination changing position.

42. The combination lock of claim 40, wherein the movable member comprises a push button accessible from the same side of the combination lock as the dials, and spring means for biasing the push button to the combination fixing position, the push button being depressable against the bias of the spring means when the push button is moved to the combination changing position.

43. The combination lock of claim 42, wherein the push button has a projection, and the preventing means comprises a bracket attached to the actuator which is positioned adjacent to the projection, one side of the projection being engageable with the bracket to prevent movement of the push button to the combination changing position, and the other side of the projection being engageable with the bracket to prevent movement of the push button to the combination fixing position.

44. The combination lock of claim 42, wherein the push button has cam means for moving the sleeves longitudinally with respect to the axis of the shaft to uncouple the sleeves from the dials when the push button is moved to the combination changing position.

45. The combination lock of claim 39, further comprising a rocker supported on the frame for rotation between first and second positions, the rocker being coupled to the actuator for concerted movement therewith such that when the actuator is in its rest position the rocker is in its first position and such that when the actuator is in its open position the rocker is in its second position, and blocking means cooperable with the sleeves for preventing movement of the rocker from its first position except when the sleeves have said predetermined orientation.

46. The combination lock of claim 33 or 39, wherein the combination lock is mounted in a hardware assembly for luggage and the like, the hardware assembly comprising a housing adapted to be mounted on a first part of the luggage case, a pair of sliding latches within the housing cooperable with associated hasps on a second part of the luggage case for holding the case closed when the parts are brought together, and means connecting the latches to the actuator for moving the latches to unlatching position when the actuator moves to open position.

47. The combination lock of claim 46, wherein the combination lock and the hardware assembly are mounted on a luggage case.

48. The hardware assembly of claim 1 or 13, wherein the hardware assembly is mounted on a luggage case.

* * * * *